US006905813B2

(12) United States Patent
Habu

(10) Patent No.: US 6,905,813 B2
(45) Date of Patent: Jun. 14, 2005

(54) PROCESSING AGENT FOR SILVER HALIDE COLOR PHOTOSENSITIVE MATERIAL AND PROCESSING METHOD THEREOF

(75) Inventor: Hiroyuki Habu, Matsudo (JP)

(73) Assignee: Chugai Photo Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/228,193

(22) Filed: Aug. 27, 2002

(65) Prior Publication Data

US 2003/0157444 A1 Aug. 21, 2003

(30) Foreign Application Priority Data

Aug. 29, 2001 (JP) ..... 2001-259398

(51) Int. Cl.[7] ..... G03C 7/30; G03C 7/42
(52) U.S. Cl. ..... 430/455; 430/463
(58) Field of Search ..... 430/455, 463; 564/487

(56) References Cited

U.S. PATENT DOCUMENTS

| | | | | | |
|---|---|---|---|---|---|
| 5,262,570 | A | * | 11/1993 | Shimasaki et al. | 564/487 |
| 5,449,593 | A | * | 9/1995 | Morigaki et al. | 430/372 |
| 5,834,020 | A | * | 11/1998 | Margerum et al. | 424/484 |
| 6,011,029 | A | * | 1/2000 | Ding et al. | 514/221 |
| 6,156,931 | A | * | 12/2000 | Lewis | 564/123 |
| 6,169,163 | B1 | * | 1/2001 | Woo et al. | 528/397 |
| 6,444,672 | B1 | * | 9/2002 | van Boeckel et al. | 514/243 |
| 6,608,035 | B1 | * | 8/2003 | Agrawal et al. | 514/44 |

FOREIGN PATENT DOCUMENTS

| | | |
|---|---|---|
| EP | 0093002 A2 | 11/1983 |
| EP | 0231870 A2 | 8/1987 |
| FR | 1547146 A1 | 11/1968 |
| FR | 1591741 A1 | 5/1970 |
| JP | 04-130432 | 5/1992 |
| JP | 05-197111 | 8/1993 |
| JP | 07-066172 | 7/1995 |
| JP | 07-119981 | 12/1995 |
| JP | 08-190184 | 7/1996 |
| JP | 2994544 | 10/1999 |

OTHER PUBLICATIONS

European Search Report dated Dec. 5, 2002.

* cited by examiner

*Primary Examiner*—Hoa Van Le
(74) *Attorney, Agent, or Firm*—Rader, Fishman & Grauer PLLC

(57) ABSTRACT

Processing with adding either of the following compounds (a), (b) and (c) to a bleaching and fixing processing solution is performed.

(a) at least one selected from a group having a structure represented by a general formula [I] as described below;

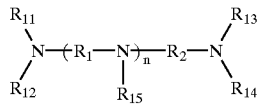

(b) at least one of an aminopyridine-type compound with acid dissociation constant (pKa) thereof is in the range of 5.5 to 8.5;

(c) at least one of a polyethyleneimines having a structure represented by the following general formula [II].

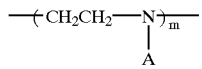

6 Claims, No Drawings

PROCESSING AGENT FOR SILVER HALIDE COLOR PHOTOSENSITIVE MATERIAL AND PROCESSING METHOD THEREOF

BACKGROUND OF THE INVENTION

1. Field of the Invention

The present invention relates to a processing agent for silver halide color photosensitive materials and processing method thereof. More particularly, the present invention relates to a processing agent for silver halide color photosensitive materials and method to improve fixing ability and stability of processing solution in a processing step including a fixing step of a consecutive processing step.

2. Description of the Related Art

Generally, as for the processing of silver halide color photosensitive materials (hereinafter stated as a "sensitive materials") is comprised of a color developing step and a silver-removing (also called "desilverization") step. The desilverization step is comprised of steps bleaching, fixing, bleaching and fixing and the like. For example, silver formed in the developing is removed by dissolving in a fixing step after being oxidized in a bleaching step with a bleaching solution. Normally, ferric ion complex salt is mainly used as the bleaching solution and a thiosulfate salt is used as the fixing solution. At present, many of the series of processes of this kind is performed in a step of continuous processing with an automatic developing machine (automatic processor). A plurality of processing tanks is provided inside the automatic processor and the photosensitive materials are transferred to each of the processing tanks with a transportation system and the developing process is being performed automatically in succession.

Incidentally, at present, automatic processors using silver halide color photosensitive materials have become diversified to match with needs of users. In order to conform with a photo-sensitive material to be used, an opening space or an amount to be mixed together of each processing tank, is particularly made different. However, in a tank used during a bleaching and fixing and/or a fixing step, a problem of declining processing quality caused by pH becoming unstable, and deteriorating stability and the like effected by the amount of oxygen and time period that each processing solution may contact with the air, remains to be solved.

In addition, an amount of processing solution used in each step is being reduced and a frequency of the processing solution being replenished is decreasing due to the effect of environmental problems. This leads to an increase in time period that the processing solution is stored in a tank, causing a problem that the thiosulfuric acid, the fixing element, decomposes to produce sulfides.

In particular, when a processing solution used in "silver-removing step" is brought into the processing tank where the following "washing step" is performed then decomposes forming a precipitate, a trouble like deterioration of image quality as white base color of photosensitive materials is being polluted and clogging of the circulation filter of automatic processors occur, which has caused a problem that the processing solution must be stabilized.

For this reason, there is a need for the production of a processing solution that can be applied to various kinds of automatic processors and can always be processed constantly.

To solve these problems, at present, countermeasures like raising pH of processing solution used in the desilverization step, applying an excessive amount of sulfite and applying sulfurous acid solution directly to the desilverization processing tank are taken.

However, in the bleaching and fixing step, ability of thiosulphate to prevent decomposition improves as having pH value of the processing solution rise, however, silver on the photosensitive materials cannot be removed completely which results in insufficient desilverization. In addition, as pH of processing liquid is raised, smell of ammonia becomes stronger and working environment worsens. In addition, even if excessive amount of sulfite is added or double quantity of sulfurous acid is poured in, for example, decomposition prevention effect will not be obtained to the same extent as the added amount of sulphite or sulfurous acid, and causes a side effect that desilverization speed slows down. Moreover, with regard to adding sulfurous acid directly, sulphite had to be added before the decomposition since adding thereof after decomposition does not produce any effects, causing a problem of inefficiency in operation.

To solve this problem, for example, as a sulfuration inhibitor, sulfinic acid type compounds are described in Japanese Patent No. 2994544 and Examined Japanese Patent Application No. 7-119981 and No. 7-66172. Further, as a pH buffer agent, imidazole type compounds are described in Unexamined Japanese Patent Application No. 8-190184, No. 5-197111, and No. 4-130432.

SUMMARY OF THE INVENTION

However, as a processing agent having both effects as a sulfuration inhibitor and a pH buffer agent, no agent has met the expectation in terms of effectiveness.

The present invention is made under an above-mentioned circumstances and an object thereof is to provide a processing agent of high quality in fixing and in the same time enables a processing solution to be used stably for a long time period, as well as a processing method using thereof.

The above-mentioned objective has been achieved with the processing agent and the processing method of the present invention.

A processing agent of the present invention is a processing agent of silver halide color photosensitive materials having a characteristic of comprising at least one of the following compounds (a),(b) and (c):

(a) at least one selected from a group having a structure represented by the following general formula [I],

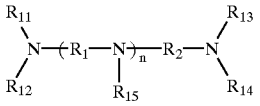

wherein, in the formula [I], each of R.sup.1 and R.sup.2, represents at least one of a normal chain and a branching alkylene group which may be substituted for amino group. Moreover, n is an integer of 0 to 2 and R.sup.11, R.sup.12, R.sup.13, R.sup.14 and R.sup.15 each represents at least one a hydrogen atom and a normal chain or a branching alkyl group having 1 to 4 carbon atoms, the alkyl group may be substituted for at least one of an amino group, a sulfone group and a hydroxyl group and acid dissociation constant (pKa) is in the range of 5.5–8.5;

(b) at least one of aminopyridine-type compound with acid dissociation constant (pKa) thereof is in the range of 5.5–8.5;

(c) at least one of polyethyleneimines having a structure represented by the following general formula [II],

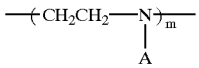

In addition, a processing method related to the present invention is the processing method having a processing step with a color developing step and a fixing ability, and having a washing step, and is characterized by adding the processing agent to the processing solution used in the processing step having the fixing ability.

According to a processing agent and a processing method of silver halide color photosensitive materials of the present invention, processing stably with a small amount of replenishment has become possible with adding at least one of the above-mentioned compounds to a processing solution having the fixing ability, by preventing sulphides from forming caused by the decomposition of the thiosulphate.

The compound (a), (b) and (c) has a characteristic of being used in a processing solution within the range of 0.025 to 5 mol/l. As explained above, the processing agent of the present invention causes the fixing ability to improve and stabilize the processing solution by adding a small amount thereof to the processing solution.

Moreover, the processing step having the fixing ability has a characteristic of being processed within the range of pH 6.3 to 8.0. With this method, continuous processing with the processing solution being at stable condition becomes possible as time lapses.

DESCRIPTION OF THE PREFERRED EMBODIMENTS

Next, a processing agent for silver halide photosensitive materials that the present invention is applied to and the method of processing thereof will be explained.

First, the compounds of the present invention (a), (b) and (c) are explained.

The compound (a) of the present invention is a compound as shown in the following general formula [I];

A general formula [I]

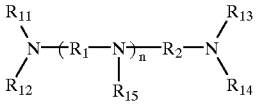

Here, R.sup.1 and R.sup.2 represent at least of a normal chain and a branching alkylene group preferably having two to four carbon atoms.R.sup.1 and R.sup.2 may be substituted for amino group. Further, n is an integer of 0 to 2.

Each of R.sup.11, R.sup.12, R.sup.13, R.sup.14 and R.sup.15 represents at least a hydrogen atom, a normal chain alkyl group having one to four carbon atoms and a branching alkyl group with each having a number of one to four carbon atoms. Further, each group may be substituted for at least of an amino group, a sulfone group and a hydroxyl group. The group should preferably be substituted for a hydroxyl group.

pKa of the compound (a) has a range of 5.5 to 8.5 and preferably 6.3 to 7.8. This is because when pKa is not more than 5.5, pH of the processing solution decreases, accelerating the decomposition of thiosulphate, however when pKa is not less than 8.5, the bleaching quality worsens.

Examples of the compounds as explained above are listed below:

ethylenediamine (pKa7.47),
N-methylethylenediamine (pKa7.56),
N-ethylethylenediamine (pKa7.63),
N-n-propylethylenediamine (pKa7.54)
N-isopropylethylenediamine (pKa7.70),
N-(2-hydroxylethyl)ethylenediamine (pKa7.21),
N,N-dimethylethylenediamine (pKa6.79),
N,N-diethylethylenediamine (pKa7.07),
N,N'-dimethylethylenediamine (pKa7.47),
N,N'-diethylethylenediamine (pKa7.77),
N,N'-di-n-propylethylenediamine (pKa7.53),
N,N'-di(2-hydroxylethyl)ethylenediamine (pKa7.18),
N,N,N',N'-tetramethylethylenediamine (pKa6.56),
1,2-diaminopropane (pKa7.13),
meso-2,3-diaminopropane (pKa6.92),
triethylenetetramine (pKa6.67),
1,2,3-triaminopropane (pKa7.95),
1,3-diamino-2-aminomethylpropane (pKa6.44) and the like.

The compound (b) is an aminopyridine-type compound with acid dissociation constant (pKa) thereof is in the range of 5.5–8.5. The pKa should preferably be in the range of 6.3 to 7.8, this is because when pKa is not more than 5.5, the pH of the processing solution decreases, expediting the decomposition of the thiosulphate, however when pKa is not less than 8.5, the bleaching ability worsens. Concretely, compounds such as 2-aminopyridine (pKa 6.78), 3-aminopyridine (pKa 6.06) can be cited as examples.

In addition compound (c) is a compound having a structure of a following general formula [II].

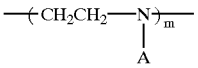

In the formula [II], A represents at least one of a hydrogen atom and a hydroxyl group, and n is an integer of 4 to 360.

Molecular weight is 200 to 15,000. Further, m is preferably in the range of 4 to 8 and in the range of 14 to 360. When m is out of the above-mentioned range, the processing solution become turbid as the solution is brought into the washing tank, not preferable as far as appearance thereof is concerned and also obtaining and/or synthesizing etc. of such processing solution is difficult and thus impractical.

Concretely,
tetraethylenepentamine,
pentaethylenehexamine,
and polyethyleneimine that m is not less than 14 can be cited as examples.

Examples of the illustrated compounds described above as (a), (b) and (c) are;
N,N-diethylethylenediamine,
triethylenetetramine,
tetraethylenepentamine,
pentaethylenehexamine,
polyethyleneimine,
and 2-aminopyridine.

Specific examples of the compounds regarding the present invention are shown above, however, compounds of the present invention should not be construed as being limited thereto.

A processing agent of the present invention includes at least one of the compounds (a), (b) and (c) explained above, and each of the (a), (b), and (c) may be used alone or in combination with others.

The compound of the present invention is preferably added to the processing solution used in processing steps having fixing ability. Here, the processing solution having fixing ability may be either of fixing solution or bleaching and fixing solution. The concentration thereof is preferably in the range of 0.0025 to 5 mol/l.

Next, a processing method of the present invention will be explained. The processing method of the present invention basically includes color developing step, desilverization step, and washing step. Namely, the series of steps in the developing process is performed with developing photosensitive materials using color developing solution, then oxidizing and dissolving silver formed in desilverization step, and removing the silver with water in washing step or washing performed in the stabilizing step including pigment stablizing agent and antifungal agent. In addition, normally, it is preferable to provide a drying step drying the photosensitive materials having undergone all the necessary processing, after the washing step.

Here, the desilverization step is basically comprised of a bleaching step where oxidizing silver formed in the development with using bleaching solution and a fixing step where turning the oxidized silver into a soluble silver salt with using a fixing solution. Each of the bleaching step and the fixing step can be performed as a separate step with using the bleaching solution and the fixing solution, however, the bleaching step and the fixing step may be performed integrally with using a bleaching and fixing solution, a mixture of the bleaching solution and the fixing solution, that enables bleaching and fixing to be performed simultaneously, (a bleaching and fixing step) Further, depending on processing steps, the bleaching step, the fixing step and the bleaching and fixing step can be combined together as they seem appropriate, for example, providing the bleaching and fixing step using the bleaching and fixing solution even after performing the bleaching step or the fixing step. Specifically the following sequences can be cited as examples of the processing method of the present invention. However, it should be noted that the present invention is not limited to the embodiments mentioned below.

(i) Color Developing-Bleaching-Fixing-Washing (stabilizing)-Drying (ii) Color Developing-Bleaching-Bleaching and fixing-Washing(stabilizing)-Drying (iii) Color Developing-fixing-Bleaching and fixing-Washing(stabilizing)-Drying (iv) Color Developing-Bleaching and fixing-Washing (stabilizing)-Drying Inside the automatic developer, there provided a plurality of processing tanks, filled with processing solutions of each step adjusted to a predetermined condition, and photosensitive materials are automatically transferred with a transferring system while having made contact with the processing solutions step by step and the processing is being performed continuously. In addition, the processing solution used in each step is replenished in an appropriate timing, and the amount to be replenished is normally determined by a surface area of the photosensitive materials or types thereof.

The processing agent of the present invention may be added to a processing solution used in a step other than the color developing step, however, it may also be added to a processing solution of one of the steps. Especially it is preferably added to the processing solution used in desilverization step (bleaching, fixing, bleaching and fixing step), namely, a processing step having fixing ability. In continuous processing, for example, when taking a series of steps (i), the processing agent may be added to the fixing tank or added to the bleaching tank so that it will be brought into the fixing tank by "carry over". When taking a series of steps (ii) and (iii) the processing agent may be added to either of the bleaching tank, the fixing tank, or the bleaching and fixing tank.

In addition, as a method of the water washing (stabilization) step, a single tank, multistage counterflow cascade system, multistage parallel flow system or any of the systems may be adopted, however, the multistage counterflow cascade system, is , for example, preferable.

The multistage counterflow cascade system has a structure that not less than two washing tanks are provided inside the automatic developer, and with supplying rinsing solution to the last tank, the replenished solution overflows to the tank placed in the front thereof then to the next, one at a time, and ultimately the waste liquid is drained from the forefront tank. In such case, the processing solution flows from the opposite direction to the direction that processing of the photosensitive material proceeds, therefore, salts attached to the photosensitive material can gradually be washed away with cleaner processing solutions. With this system, the salts attached to the photosensitive materials can be removed as in the case of using running water, with small amount of processing solution.

Each of the steps is explained in details as follows.

Color Developing Step

In the color developing step, a color developing solution including additives such as a base, antioxidant, chelate agent, as shown below is used.

Para phenylenenediamine type is preferred as a base and examples thereof are listed as follows:

4-amino-3-methyl-N,N-diethylaniline,
4-amino-3-methyl-N-(β-hydroxyethyl)aniline,
4-amino-3-methyl-N-ethyl-N-(β-methane sulfonamiade ethyl)aniline,
4-amino-3-methyl-N-ethyl-N-(β-hydroxyethyl)aniline,
4-amino-3-(β-methanesulfamide ethyl)aniline,
4-amino-3-methyl-N(β-methoxyethyl)aniline,
4-amino-3-butyl-N(β-butyl sulfonate)aniline, and the like.

The amount of base to be used is preferably in the range of 0.005 to 0.08 mol/l, more preferably 0.01 to 0.06 mol/l.

Hydroxylamine and hydroxylamine derivative are preferred to be used as an antioxidant. Specifically the following compounds are cited;

Hydroxylamine,
diethylhydroxylamine,
N,N-bis(2-sulfoethyl)hydroxylamine and the like.

The amount of base to be used is preferably in the range of 0.0005 to 0.08 mol/l, more preferably 0.01 to 0.06 mol/l.

Further, sulfites can be used as an antioxidant of the present invention. In such case, the amount to be used is preferably in the range of 0.0005 to 0.06 mol/l.

Aminopolycarboxylic acid,
aminopolyphosphonic acid,
alkylphosphonic acid,
and phosphonocarboxylic acid and the like can be used as a chelate agent.

Concretely, ethylenediaminetetraacetic acid,
Nitorilo triacetic acid,
diethylentriamin pentaacetic acid,
cyclohexanediaminetetraacetic acid,
hydroxyethyliminodiacetic acid,
1-hydroxyethylidene-1,1-diphosphonic acid,
nitrilo-N,N,N-trimethylenephosphonic acid,
ethylendiaminetetramethylenephosphonic acid and the like, are preferably used and, the amount is preferably be 0.1–5.0 g/l.

Sodium hydroxide, potassium hydroxide etc., can be used as alkali chemicals.

As a pH buffer agent, borate, carbonate, bicarbonate and phosphate and the like of alkali metals can be used.

Apart from the above, as a chemical agent such as a development inhibitor, bromide salt, iodide salt, benzimidazoles and benzothiazoles of alkali metals can be used.

Further, organic solvents like ethylene glycol, diethylene glycol, polyethylene glycol, N-methyl-2-pyrrolidone may be added.

In addition, a surfactant like polyoxyethylenealkylphenylether, or a fluorescent brightening agent of triazinylstilbene type may be added.

The pH applied to the color development solution of the present invention is preferably in the range of 9.0 to 11.0, and more preferably 9.5 to 10.5. Further, the amount of replenishing solution to be replenished is preferably in the range of 15 to 2000 ml per 1m2 of the photosensitive material.

And the processing time is preferably in the range of 20 seconds to 4 minutes and processing temperature is preferably in the range of 30 to 45 Celsius.

Desilverization Step

Desilverization step described here includes a bleaching step, a fixing step and a bleaching and fixing step in which the bleaching step and the fixing step are being integrated, as well as a processing step appropriately combining each of these steps.

Examples of processing solutions used in the desilverization step are bleaching solution used in the bleaching step, fixing solution used in the fixing step and bleaching and fixing solution used in the bleaching and fixing step.

The ability of the processing agent of the present invention becomes prominent by being used with ordinary bleaching, fixing or bleaching and fixing solution. The amount to be used thereof is preferably in the range of 0.025 to 5 mol/l. When the amount to be added is too small, solution stablizing effect becomes smaller and when too large amount is added, the system becomes unpractical.

Further, in the desilverization step of the present invention, processes are performed while the bleaching solution, the fixing solution and the bleaching and fixing solution are being replenished. And the amount to be replenished for the bleaching solution is preferably in the range of 10 to 2000 ml/m2 more preferably in the range of 15 to 1000 ml/m2. And the amount to be replenished for the fixing solution is preferably in the range of 10 to 2000 ml/m2, more preferably in the range of 15 to 1000 ml/m2. And the amount to be replenished for the bleaching and fixing solution is preferably in the range of 15 to 1000 ml/m2 more preferably in the range of 25 to 70 ml/m2.

The desilverization step has a characteristic of being processed within the range of pH 6.3 to 8.0. Within this range, processing can be performed stably as time lapses.

The processing agent of the present invention can be added to either of the processing tanks used in the processing steps from bleaching to fixing. For example, the processing agent may be added to the bleaching tank and brought to the fixing tank as a part of continuous processing, and in the case of bleaching and fixing tank, the processing agent may be added to either of the bleaching solution and fixing solution so that it will be mixed at the time of processing.

Bleaching Step

In the bleaching step of the present invention, bleaching solution including bleaching base that will be described later, bleaching accelerator, re-halogenation agent, pH buffer agent, and other additives can be used.

Aminopolycarboxylic acid iron (III) salt or persulfuric acid are used as a base of bleaching chemical.

Specifically, iron (III) salts like
ethylenediaminetetraacetic acid,
1,3-propanediaminetetraacetic acid,
diethylenetriaminepentaacetic acid,
1,2-cyclohexanediaminetetraacetic acid,
iminodiacetic acid, methyliminodiacetic acid,
nytrilo triacetic acid,
hydroxymethyliminodiacetic acid,
N-(2-carboxyethyl)iminodiacetic acid,
N-(2-carboxymethyl)iminodiacetic acid,
β-alaninediacetic acid,
ethylenediamine-N,N'-disuccinic acid,
1,3-propanediamine-N,N'-disuccinic acid,
ethylenediamine-N,N'-dimalonic acid,
and 1,3-propanediamine-N,N'-dimalonic acid can be used.

The amount of base to be used is preferably in the range of 0.005 to 2 mol/l and more preferably 0.01 to 1.0 mol/l.

Bleaching accelerator such as mercapto compounds, disulfide compounds and thiol compounds may be used as a bleaching solution of the present invention.

Further, bromide salt, iodide salt of alkali metals, ammonium bromide and the like may be used as re-halogenation agent.

Moreover, organic acids such as acetic acid, propionic acid, succinic acid, malonic acid, maleic acid, glutaric acid and oxalic acid, may be used as pH buffer agents.

In addition, in order to prevent corrosion of stainless steel of the processing tank, nitrates such as ammonium nitrate and sodium nitrate are used as corrosion inhibitors. The concentration of nitric acid compound is preferably in the range of 0.3 to 4.0 mol/l, more preferably 0.5 to 3.5 mol/l.

The pH applied to the bleaching solution of the present invention is preferably in the range of 3.0 to 6.0, and more preferably 4.0 to 5.0. Further, the amount of bleaching solution to be replenished is preferably in the range of 25 to 200 ml per lm2 of the photosensitive material.

The time to be taken for bleaching is preferably in the range of 20 seconds to 7 minutes and processing temperature is preferably in the range of 30 to 45 Celsius.

Fixing Step 1n the fixing step of the present invention, fixing solution including fixing base and decomposition inhibitor, chelate agent and other additives as described below are used.

Thiosulphate such as ammonium thiosulphate or sodium thiosulfate is preferably used as the fixing base.

In addition, not less than two kinds of other fixing agent of public knowledge, thiocyanates such as sodium thiocyanate, potassium thiocyanate, ammonium thiocyanate, or thioethel compound like ethelenebisthioglicol and thio urea may be used at one time.

The concentration of the fixing base is preferably in the range of 0.1 to 5.0 mol/l, more preferably 0.3 to 4.0 mol/l and most preferably 0.5 to 3.0 mol/l.

As decomposition inhibitors, sulfites such as ammonium sulfite, potassium sulfite and sodium sulfite, bisulfites such as ammonium bisulfite, potassium bisulfite and sodium bisulfite, meta-bisulfites such as ammonium meta-bisulfites, potassium meta-bisulfurous, sodium meta-bisulfurous, reductones such as hydroxylamines, ascorbic acid, and sulfinic acid and the like can be used as needed.

The decomposition inhibitors are used in the range of 0.001 to 1.5 mol/l, preferably in the range of 0.03 to 1.0 mol/l, and more preferably 0.05 to 0.5 mol/l.

Aminopolycarboxylic acid,
aminopolyphosphonic acid,
alkylphosphonic acid,
and phosphonocarboxylic acid and the like can be used as a chelate agent.

Specifically, ethylenediaminetetraacetic acid,
1,2-propylenediaminetetraacetic acid,
diethylenetriaminepentaacetic acid,
1,2-cyclohexanediaminetetraacetic acid,
iminodiacetic acid,
methyliminodiacetic acid,
nitrilo triacetic acid,
hydroxymethyliminodiacetic acid,
N-(2-carboxyethyl)iminodiacetic acid,
N-(2-carboxylmethyl)iminodiacetic acid,
β-alanine diacetic acid,
hydroxyethyliminodiacetic acid,
1-hydroxyethylidene-1,1-diphosphonic acid,
nitorilo-N,N,N-trimethylenephosphonic acid,
and ethylenediaminetetramethylenephosphonic acid can be mentioned as examples.

Further, the amount of the chelate agent to be used is preferably in the range of 0.1 to 5 g/l.

The pH applied to the fixing solution of the present invention is preferably in the range of 6.3 to 8.0, and more preferably 6.8 to 7.5. Further, the amount of fixing solution to be replenished is preferably in the range of 15 to 1000 ml per 1m2.

The processing time is preferred to be in the range of 20 seconds to 5 minutes. And processing temperature is preferably in the range of 30 to 45 Celsius.

Bleaching and Fixing Step

For the bleaching and fixing step of the present invention, chief fixing chemical, bleaching and fixing accelerator, decomposition inhibitor, chelate agent and the like can be used.

Similar to the bleaching solution described above, aminopolycarboxylic acid iron (III) salt or persulfuric acid is used as a base of bleaching chemical.

For the bleaching solution, an iron complex salt previously prepared to form a complex as a ferric complex salt may be used, or complexes may be formed in the solution by having ferric sulfate salt, ferric nitrate salt, ferric chloride and the like coexist with a complex compound.

Specific examples of aminopolycarboxylic acids are,
ethylenediaminetetraacetic acid,
1,3-propanediaminetetraacetic acid,
diethylenetriaminepentaacetic acid,
1,2-cyclohexanediaminetetraacetic acid,
iminodiacetic acid,
methyliminodiacetic acid,
nytrilo triacetic acid,
hydroxymethyliminodiacetic acid,
N-(2-carboxyethyl)iminodiacetic acid,
N-(2-carboxymethyl)iminodiacetic acid,
β-alanine diacetic acid,
ethylenediamine-N,N'-disuccinic acid,
1,3-propanediamine-N,N'-disuccinic acid,
ethylenediamine-N,N'-dimalonic acid,
and 1,3-propanediamine-N,N'-dimalonic acid.

The amount of base to be used is preferably in the range of 0.005 to 2 mol/l and more preferably 0.01 to 1 mol/l.

Thiosulphate such as ammonium thiosulfate or a sodium thiosulfate is preferably used as a fixing base. In addition, not less than two kinds of other fixing agents of public knowledge,
thiocyanates such as sodium thiocyanate,
potassium thiocyanate,
ammonium thiocyanate,
or thioethel compound like ethelenebisthioglicol acid and thiourea may be used at one time.

An amount of the fixing base to be used is in the range of 0.005 to 5.0 mol/l and preferably 0.01 to 2.5 mol/l, more preferably 0.01 to 1.0 mol/l.

Examples of the bleaching accelerators to be used in the bleaching and fixing solution are mercapto compounds, other disulfide compounds and thiol compounds.

Specifically, 3-mercapto-1,2,4-triazol,
diethylaminoethanethiol,
and the like can be cited as examples.

Further, as a decomposition inhibitor, sulfites such as ammonium sulfite, sodium sulfite, bisulfites such as ammonium bisulfite and potassium bisulfite, meta-bisulfites such as ammonium meta bisulfite and potassium meta bisulfite, reductones such as hydroxylamines and ascorbic acid, and sulfinic acid and the like can be used as needed.

An amount of decomposition inhibitor to be used is in the range of 0.005 to 3.0 mol/l and preferably 0.005 to 2.0 mol/l, more preferably 0.005 to 1.0 mol/l.

Similar to the fixing solution described above,
aminopolycarboxylic acid,
aminopolyphosphonic acid,
alkylphosphonic acid,
and phosphonocarboxylic acid
and the like can be used as a chelate agent. The amount to be used thereof is preferably in the range of 0.1 to 5.0 g/l.

As a pH applied to the bleaching and fixing solution of the present invention, 6.3 to 8.0 is preferred.

When pH is not more than 5.5, the decomposition of thiosulphate expedites, however when pH is not less than 8.5, the bleaching quality worsens.

And the time to be taken for processing is preferably in the range of 20 to 120 seconds and processing temperature is preferably in the range of 30 to 45 Celsius.

Washing Step

In the washing step of the present invention, rinsing solution containing chemical rinse agent, water droplet inhibitor, antimicrobe/antifungal agent, chelate agent, pigment stablizing agent and the like can replace large amount of water for washing in the washing step.

Surfactants can be used as a water droplet inhibitor. Nonion-type surfactants are especially preferable.

Isothiazoline type compound and halogen releasing type compound can be used as antimicrobe/antifungal agent.

The same color developing solution and bleaching and fixing solution as described above can be used as a chelate agent.

Formalin-releasing compounds such as formalin, aldehydes or methylolurea, or hexamethylenetetramine can be used as pigment stablizer.

In addition, in order to prevent attachment of particles caused by static electricity onto the photosensitive materials after drying, antistatic agent such as sulfo-succinicacid dioctyl ethel, lauroylsarcosinsodium, distearyldimethylammonium chrolide, or fluorescent brightening agent such as triazinylstilbene-type may be included.

Further, organic solvents such as diethylene glycol, ethanol, ethylene glycol, N-methyl-2-pyrrolidone, butyl cellosolve, γ-butyrolactone, and triethanolamine may be used.

Moreover, organic acids such as acetic acid, propionic acid, succinic acid, maleic acid, glycine, taurine, glycolic acid may be used as pH buffer agents.

Further, the amount of rinsing solution to be replenished is preferably in the range of 25 to 2500 ml per 1m2 of the photosensitive material.

The rinsing solution is preferably in the range of pH 3 to 9 and more preferably pH 4 to 8. Further, the amount of rinsing solution to be replenished during the continuous processing is preferably in the range of 25 to 2500 ml per 1m2 of the photo-sensitive material and more preferably in the range of 150 to 1800 ml per 1m2.

And processing temperature is preferably in the range of 30 to 45 Celsius. And the time to be taken for processing is preferably in the range of 15 seconds to 10 minutes and more preferably 30 seconds to 5 minutes.

Regarding a tank used for washing process of the present invention, a single tank, multistage counterflow cascade system, multistage parallel flow system or any of the systems may be adopted, however, multistage counterflow cascade system is preferable.

In the multistage counterflow cascade system, not less than two washing tanks are provided, and the structure thereof is such that the rinsing solution replenished to the last tank overflows and flows into the tank placed in the front thereof then to the next, one at a time, thus the concentration of salts in the last tank becomes the lowest of all the tanks. With this system, the salts attached to the photosensitive materials can be removed as in the case of using running water, with small amount of processing solution. And the number of processing tanks is preferably in the range of 2 to 8.

Drying Step

This step is to dry the photosensitive materials with hot air after having undergone processing in each of the processing steps, and can be performed with a method of public knowledge. The temperature for drying is in the range of 50 to 80 Celsius and the time to be taken for drying is in the range of 30 seconds to 5 minutes.

Examples of photographic materials relating to the present invention are, ordinary multi-layered silver halide photographic material, (for example, color negative film, color reversal film, color positive film, color negative film for film industry, color positive film, color photographic paper, inversion color photographic paper, direct positive color photographic paper and the like) and infrared light sensitive materials for a laser scanner.

EXAMPLES

Hereinafter with reference to the examples, details of the present invention will be described. It should be noted that the present invention is not limited to these examples.

Example 1

Running Test 1

Objectives: When an automatic developer with a big opening area (that means the disassembly of thiosulphate is likely to occur) is used, and operation is continued with a little amount for processing, side effects caused by decomposition would occur. For this reason, an experiment was performed according to the following method and ability to prevent troubles caused by decomposition has been examined.

| Adjustment of color developing solution | |
|---|---|
| 85 wt % N,N-diethylhydroxylamine | 1.5 g |
| 80% triethanolamine | 15 g |
| Stilbene-type fluorescent brightening agent | 10 g |
| 49 wt % Potassium carbonate | 65 g |
| CD-3 (4-amino-methyl-N-methyl-N[(β-methane sulfonamide)ethyl]aniline3/2sulfuric acid monohydrate) | 4.5 g |
| Water was added to adjust to | 1 L |
| pH was adjusted to 10.0. | |
| <Adjustment of color developing solution for replenishment> | |
| 85 wt % N,N-diethylhydroxylamine | 5 g |

-continued

| | |
|---|---|
| 80% triethanolamine | 15 g |
| Stilbene-type fluorescent brightening agent | 10 g |
| KOH (flake) | 10 g |
| 49 wt % Potassium carbonate | 65 g |
| CD-3 | 15 g |
| Water was added to adjust to | 1 L |
| PH was adjusted to 12.6. | |
| <Adjustment of Bleaching and fixing solution for replenishment> | |
| Ethylenediamine Fe (III) ammonium salt | 0.35 mol |
| Ammonium thiosulfate | 1.22 mol |
| Ammonium bisulfite | 0.52 mol |
| The compound of the present invention | Table 1 |
| Ethylenediaminetetraacetic acid | 0.04 mol |
| Water was added to adjust to | 1 L |
| Adjust to pH 6.1 with nitric acid and ammonia | |

TABLE 1

| No. | Additives | Added Amount | pKa |
|---|---|---|---|
| 1 (Comparative Example) | None | — | — |
| 2 (Comparative Example) | Sodium sulfite | 0.60 | 7.19 |
| 3 (Comparative Example) | Imidazoles | 0.35 | 6.95 |
| 4 (Comparative Example) | 1,3-diaminobutane | 0.35 | 8.74 |
| 5 (Comparative Example) | 1,4-diaminobutane | 0.35 | 9.44 |
| 6 (Present Invention) | N,N-diethylethylene-diamine | 0.35 | 7.07 |
| 7 (Present Invention) | Triethylenetetramine, | 0.35 | 6.67 |
| 8 (Present Invention) | Pentaethylenehexamine, | 0.35 | — |
| 9 (Present Invention) | 2-aminopyridine | 0.35 | 6.78 |

<Adjustment of Bleaching and Fixing Solution>

Bleaching and fixing solution described above, after being diluted by 50%, was used.

<Adjustment of Aqueous Solution Used for Rinsing>

Aqueous solution of 2-bromo-2-nitro-propandiol 0.005 mol/l was used.

<Condition of Experiment>

Automatic Developer: QSS2301 (a product of Noritsu Koki Co. Ltd.)

| Amount of replenishment: | |
|---|---|
| Color developing solution | 45 ml/m2 |
| Bleaching and Fixing solution | 35 ml/m2 |
| Aqueous solution used for rinsing | 250 ml/m2 |
| Amount processed: | 500 pictures of L size/day |
| Period of the experiment: | 1 month |

Sensitive material processed: Aqulean MV paper (a product of Chugai Photo Chemical Co.Ltd.)

Processing step: The photo sensitive material was processed according to the steps shown below.

| Step | Time | Temperature |
|---|---|---|
| Color developing | 46 seconds | 38 Celsius |
| Bleaching and Fixing | 46 seconds | 38 Celsius |
| Washing (Stablizing) | 1 minute 31 seconds | 35 Celsius |
| Drying | 31 seconds | 65 Celsius |

Method of Evaluation:

1. Evaluation with checking the amount of decomposed materials attached to filters of the first and the second processing tank with naked eyes.

2. Checking the existence or non-existence of decomposed materials attached to filters of the first and the second processing tank with naked eyes.

After Aqulean MV2 control strip (a product of Chugai Photo Chemical Co. Ltd.) was processed, stain concentration was measured using X-Rite Photographic Densitimometer 310 (a product of X-Rite Inc.) then difference in concentration between the yellow stain and the control strip was measured. The difference in concentration, namely, the increase in the amount of the yellow stain was less than 0.05, was considered as acceptable.

3. Examination on Desilveriziation Ability

Aqulean MV2 control strip (a product of Chugai Photo Chemical Co. Ltd.) was being processed and the visual concentration of yellow patch on the control strip was measured. X-rite Photgraphic Densitimometer 310 was used for the measurement. In this measurement, when the measured value of the yellow visual concentration was not less than 0.25, it was considered as having desilverization failure.

The result of the experiment is shown in the table 2 below.

TABLE 2

| Example No. | Existence/ non-existence of attached materials | Y. stain | Amount of replenishment: | Y visual | Overall evaluation |
|---|---|---|---|---|---|
| 1 (Comparative Example) | +++ | 0.21 | 35 | 0.23 | x |
| 2 (Comparative Example) | ++ | 0.16 | 35 | 0.23 | x |
| 3 (Comparative Example) | + | 0.2 | 35 | 0.23 | x |
| 4 (Comparative Example) | ++ | 0.2 | 35 | 0.28 | x |
| 5 (Comparative Example) | ++ | 0.05 | 35 | 0.30 | x |
| 6 (Present Invention) | – | 0.01 | 35 | 0.23 | ○ |
| 7 (Present Invention) | – | 0.01 | 35 | 0.23 | ○ |
| 8 (Present Invention) | – | 0.03 | 35 | 0.23 | ○ |
| 9 (Present Invention) | – | 0.02 | 35 | 0.23 | ○ |

Note)
Measuring unit for added amount: mol/L
Measuring unit for amount to be replenished: m1/m2
In the table the following signs indicate:
–: No attachment of decomposed materials.
+: Very little amount of attachment of decomposed materials on the filter.
++: Little amount of attachment of decomposed materials on the filter.
+++: Large amount of attachment of decomposed materials on the filter.

Compared to the example where compounds of prior arts were added, in the experiment using the processing solution with the compound of the present invention, no attachment of the materials could be found, and managed to keep the value of yellow stain low.

Example 2

Running Test 2

Objective: When a running process with a large processing amount is performed with an automatic developer with a small opening area in which decrease in pH caused by oxidation would hardly occur, the running pH increases excessively causing desilverization failure. For this reason, an examination was made on desilverization failure with the following conditions.

<Adjustment of Processing Solution>

All processing solutions other than bleaching and fixing solution was adjusted to be the same as Example 1.

<Adjustment of Bleaching and Fixing solution for replenishment>

| | |
|---|---|
| Ethylenediamine.Fe (III) ammonium salt | 0.35 mol |
| Amonium thiosulfate salt | 1.22 mol |
| Ammonium bisulfite | 0.52 mol |
| The compound of the present invention | Table 3 |
| Ethylene diamine tetraacetic acid | 0.04 mol |
| Water was added to adjust to | 1 L |
| Adjust to pH 6.1 with nitric acid and ammonia | |

TABLE 3

| Example No. | Additives | Added Amount | pKa |
|---|---|---|---|
| 1 (Comparative Example) | None | — | — |
| 2 (Comparative Example) | Sodium sulfite | 0.60 | 7.19 |
| 3 (Comparative Example) | Imidazoles | 0.35 | 6.95 |
| 4 (Comparative Example) | 1.3-diaminobutane | 0.35 | 8.74 |

TABLE 3-continued

| Example No. | Additives | Added Amount | pKa |
|---|---|---|---|
| 5 (Comparative Example) | 1.4-diaminobutane | 0.35 | 9.44 |
| 6 (Present Invention) | N,N-diethyl ethylene diamine | 0.35 | 7.07 |
| 7 (Present Invention) | Triethylene tetramine, | 0.35 | 6.67 |
| 8 (Present Invention) | N,N,N',N'-tetramethyl ethylene diamine | 0.35 | 6.56 |
| 9 (Present Invention) | Pentaethylene hexamine, | 0.35 | — |
| 10 (Present Invention) | 2-aminopyridine | 0.35 | 6.78 |

<Adjustment of Bleaching and Fixing Solution>

Bleaching and fixing solution described above, after being diluted by 50%, was used.

<Condition of Experiment>

Automatic Developer: QSS1201 (a product of Noritsu Koki Co. Ltd.)

| Amount of replenishment: | |
|---|---|
| Color developing solution | 45 ml/m2 |
| Bleaching and Fixing solution | 35 ml/m2 |
| Aqueous solution used for rinsing | 250 ml/m2 |
| Amount processed: | 1500 pictures of L size/day |
| Period of the experiment: | 1 month |

Sensitive Material Processed:

Aqulean MV Paper (Product of Chugai Photo-chemical Ltd.)

Method of Evaluation;

1. pH of the running solution after the experiment.

2. Examination on desilverization ability (Visual concentration of Yellow Dmax)

Aqulean MV2 control strip (Product of Chugai Photo Chemical Co. Ltd.) was being processed and after the processing, the visual concentration of yellow patch on the control strip was measured. X-rite Photographic Densitimometer 310 was used in the measurement of the concentration.

3. Checking decomposed material attached to the filter with naked eyes (As in the Example 1)

<Results>

The result of the experiment is shown in the table 4 below.

TABLE 4

| Example No. | Existence/non-existence of attached materials | Amount of replenishment | Y-Dmax concentration | pH | Overall evaluation |
|---|---|---|---|---|---|
| 1 (Comparative Example) | +++ | 35 | 0.35 | 8.35 | xx |
| 2 (Comparative Example) | ++ | 35 | 0.30 | 8.41 | xx |
| 3 (Comparative Example) | + | 35 | 0.23 | 6.98 | x |
| 4 (Comparative Example) | + | 35 | 0.32 | 8.70 | xx |
| 5 (Comparative Example) | + | 35 | 0.38 | 8.81 | xx |
| 6 (Present Invention ) | – | 35 | 0.23 | 7.30 | ○ |
| 7 (Present Invention ) | – | 35 | 0.23 | 7.20 | ○ |
| 8 (Present Invention ) | – | 35 | 0.23 | 7.25 | ○ |
| 9 (Present Invention ) | – | 35 | 0.23 | 7.45 | ○ |
| 10 (Present Invention) | – | 35 | 0.23 | 7.10 | ○ |

Note)
Measuring unit for added amount: mol/L
Measuring unit for amount to be replenished: ml/m2

Evaluation on to the existence or non-existence of attachments in the table is the same as the Example 1.

As a result of the experiment, compared to compounds of prior arts, no attachment of the materials could be found in the experiment using the processing solution with the compound of the present invention, and desilverization ability was favorably kept, and moreover, pH of the processing solution could be kept in a favorable range.

Example 3

Experiment on the Prevention of Decomposition

Objective: Examining decomposition inhibiting ability by measuring time taken for enforced sulfuration of the bleaching and fixing solution (using solution for replenishiment) with a tank maintained at a constant temperature.

| <Adjustment of the Bleaching and Fixing solution for replenishment> | |
|---|---|
| Ethylene diamine.Fe (III) ammonium salt | 0.35 mol |
| Ammonium thiosulfate salt | 1.22 mol |
| Ammonium bisulfite | 0.52 mol |
| The compound of the present invention | Table 5 |
| Ethylenediaminetetraacetic acid | 0.04 mol |
| Water was added to adjust to | 1 L |
| Adjust to pH 6.1 with nitric acid and ammonia | |

TABLE 5

| Example No. | Additives | Added Amount | pKa |
|---|---|---|---|
| 1 (Comparative Example) | None | — | — |
| 2 (Comparative Example) | Imidazoles | 0.35 | 6.95 |
| 3 (Comparative Example) | Sodium sulfite | 0.52 | 7.19 |
| 6 (Present Invention) | N,N-diethylethylene-diamine | 0.35 | 7.07 |

TABLE 5-continued

| Example No. | Additives | Added Amount | pKa |
|---|---|---|---|
| 7 (Present Invention) | Triethylenetetramine, | 0.35 | 6.67 |
| 8 (Present Invention) | Pentaethylenehexamine, | 0.35 | — |
| 9 (Present Invention) | 2-aminopyridine | 0.35 | 6.79 |

<Condition of the Experiment>

Temperature: 100 Celsius

Method of Evaluation: Measuring time from the start of abandonment to the decomposition <Results>

The result of the experiment is shown in the table 6 below.

TABLE 6

| Example No. | Time taken for sulfuration |
|---|---|
| 1 (Comparative Example) | 1.5 |
| 2 (Comparative Example) | 4.5 |
| 3 (Comparative Example) | 1.3 |
| 6 (Present Invention) | 9.5 |
| 7 (Present Invention) | 9.5 |
| 8 (Present Invention) | 7.5 |
| 9 (Present Invention) | 7.5 |

Note)
Measuring unit for added amount: mol/L

According to this result, compared to the compounds of the prior arts, the decomposition inhibiting ability was proven to be very high when the compound of the present invention was added.

Example 4

Running Rest 3

Objective: When running with the amount to be processed being small with using an automatic developer for processing films, side effects caused by decomposing (of thiosulphate salt) in the fixing solution and stabilizing solution occurs. For this reason, an examination was made on decomposition inhibiting ability with the following conditions.

<Adjustment of Processing Solution>

| <Color developing solution for replenishment> | |
|---|---|
| Sodium bromide | 3.00 mol |
| (NH2OH)2.H2SO4 | 0.04 mol |
| Sodium bisulphite | 2 g |
| 49 wt % Potassium carbonate | 80 g |
| CD-4 (4-amino-3-methyl-N-ethyl-N(2'-hydroxylethyl)aniline monosulfate) | 0.02 mol |
| Water was added to adjust to | 1 L |
| Adjust to pH 10.15 with KOH and surfuric acid. | |
| <Color developing solution> | |
| Sodium bromide | 0.013 mol |
| (NH2OH)2.H2SO4 | 0.03 mol |
| Sodium bisulphite | 1.5 g |
| 49 wt % Potassium carbonate | 80 g |
| CD-4 (4-amino-3-methyl-N-ethyl-N(2'-hydroxylethyl)aniline monosulfate) | 0.015 mol |
| Water was added to adjust to | 1 L |
| Adjust to pH 10.15 with KOH and surfuric acid. | |
| <Bleaching solution for replenishment> | |
| acetic acid | 1.2 mol |
| 1,3-PDTA ferric salt | 0.45 mol |
| Ammonium bromide | 100 g |
| Ammonium nitrate | 100 g |
| Water was added to adjust to | 1 L |
| Adjusted to pH 3.5 | |

<Bleaching Solution>

Bleaching solution for replenishment, after being diluted by 70% to be adjusted to pH 4.5, was used.

| <Fixing solution for replenishment> | |
|---|---|
| Ammonium thiosulfate salt | 1.22 mol |
| Ammonium bisulfite | 0.52 mol |
| The compound of the present invention | Table 7 |
| Ethylene diamine tetraacetic acid | 0.04 mol |
| Water was added to adjust to | 1 L |
| Adjusted to pH 6.85 | |

TABLE 7

| Example No. | Additives | Added Amount | pKa |
|---|---|---|---|
| 1 (Comparative Example) | None | — | — |
| 2 (Comparative Example) | Sodium sulfite | 0.60 | 7.19 |
| 3 (Comparative Example) | imidazoles | 0.35 | 6.95 |
| 4 (Comparative Example) | 1,3-diaminobutane | 0.35 | 8.74 |
| 5 (Comparative Example) | 1,4-diaminobutane | 0.35 | 9.44 |
| 6 (Present Invention) | N,N-diethyl-ethylenediamine | 0.35 | 7.07 |
| 7 (Present Invention) | triethylenetetramine, | 0.35 | 6.67 |
| 8 (Present Invention) | Polyethyleneimine (m = 350) | 0.35 | — |
| 9 (Present Invention) | 2-aminopyridine | 0.35 | 6.78 |

<Fixing Solution>

Fixing solution for replenishment, after being diluted by 50% and adjusted to pH 6.85 was used.

| <Stabilizing solution for replenishment> | |
|---|---|
| Benzyldimethylammonium stearyl chrolide | 0.04 g |
| Wettol (Products of Chugai photo-chemicals) | 0.50 ml |
| dithio-2,2'-bisbensmethylamid | 0.3 g |
| hydroxybenzoic acid propyl | 0.1 g |
| diethyleneglycol | 0.5 g |
| 37 wt % HCHO | 6.0 g |
| Water was added to adjust to | 1 L |

<Stabilizing Solution>

The same composition as the stabilizing solution for replenishment

<Condition of the Experiment>

Automatic developer: QSFV50

| Amount of replenishment: | |
|---|---|
| Color developing solution | 18 ml/m |
| Bleaching solution | 4.5 ml/m |
| Fixing solution | 30 ml/m |
| Stablizing solution | 40 ml/m |
| Amount processed: | ten of 135-24 EX color negative films/day |
| Period of the experiment: | 1 month |

Method of Evaluation: Checking decomposed material attached to the filter of the first and the second tank with naked eyes <Results>

The result of the experiment is shown in the table 8 below.

TABLE 8

| Example No. | Existence/ non-existence of attached materials | Amount of replenishment | Evaluation |
|---|---|---|---|
| 1 (Comparative Example) | +++ | 30 | x |
| 2 (Comparative Example) | ++ | 30 | x |
| 3 (Comparative Example) | – | 30 | x |
| 4 (Comparative Example) | ++ | 30 | x |
| 5 (Comparative Example) | ++ | 30 | x |
| 6 (Present Invention) | – | 30 | ○ |
| 7 (Present Invention) | – | 30 | ○ |
| 8 (Present Invention) | – | 30 | ○ |
| 9 (Present Invention) | – | 30 | ○ |

Note)
Measuring unit for amount to be added: mol/l
Measuring unit for amount to be replenished: ml/m The amount to be replenished is the amount replenished for every one meter of 35 mm film.

Moreover, evaluation on to the existence or non-existence of attachments in the table is the same as the Example 1.

According to this result, compared to the compounds of the prior arts, when the compound of the present invention was added, no precipitates was confirmed in the stablization processing.

As explained above, with adding at least one of the compounds of the present invention to the processing solution used in the bleaching and fixing step, the fixing ability improves compared to the case where processing with using a bleaching and fixing solution of the prior arts, and above all, favorable effects that the stability of the solution improves can also be obtained.

The disclosure of Japanese Patent Application No. 2001-259398 filed Jun. 25, 2001 including specification, drawings and claims are herein incorporated by reference in its entirety.

Although only some exemplary embodiments of this invention have been described in details as above, those skilled in the art should readily appreciate that many modifications are possible in the exemplary embodiments without materially departing from the novel teachings and advantages of this invention. Accordingly, all such modifications are intended to be included within the scope of this invention.

What is claimed is:

1. A processing solution for silver halide color photographic sensitive material comprising:

at least one of a fixing ability and a stabilizing ability; and at least one of compounds (a) and (b):

(a) at least one selected from compounds having a structure represented by a following general formula [I], acid dissociation constant (pKa) of the compounds being in a range of 5.5 to 8.5,

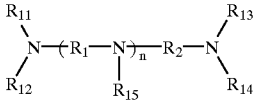

wherein, in the formula [I], each of R.sup.1 and R.sup.2, represents at least one of a normal chain and a branching alkylene group which is substituted for an amino group, and n is an integer of 0 to 2, R.sup.11, R.sup.12, R.sup.13, R.sup.14 and R.sup.15 each represents at least one of a hydrogen atom and alkyl group of a normal chain having 1 to 4 carbon atoms and a branching alkyl group having 1 to 4 carbon atoms, the normal alkyl group and the branching alkyl group are substituted for at least one of the amino group, a sulfone group and a hydroxyl group; except the formula [I] with n thereof being 0, R.sup.2 thereof having 2 or less carbon atoms and all of R.sup.11, R.sup.12, R.sup.13, R.sup.14 and R.sup.15 thereof being hydrogen atom; and (b) at least one of aminopyridine-type compounds with acid dissociation constant (pKa) thereof being in a range of 5.5–8.5.

2. The processing solution according to claim 1, wherein the compound (a) is at least one selected from a group consisting of following compounds;

N-methylethylenediamine,
N-ethylethylenediamine,
N-n-propylethylenediamine,
N-isopropylethylenediamine,
N-(2-hydroxylethyl)ethylenediamine,
N,N-dimethylethylenediamine,
N,N-diethylethylenediamine,
N,N'-dimethylethylenediamine,
N,N'-diethylethylenediamine,
N,N'-di-n-propylethylenediamine,
N,N'-di(2-hydroxylethyl)ethylenediamine,
N,N,N',N'-tetramethylethylenediamine,
1,2-diaminopropane,
meso-2,3-diaminopropane,
1,2,3-triaminopropane,
1,3-diamino-2-aminomethylpropane.

3. The processing solution according to claim 1, wherein the compound (b) is at least one selected from a group consisting of 2-aminopyridine and 3-aminopyridine.

4. The processing solution according to claim 1, wherein the processing agent includes 2-aminopyridine.

5. The processing solution according to claim 1, wherein at least one of the compounds (a) and (b) is used in a range of 0.025 to 5 mol/l in a processing solution.

6. The processing solution according to claim 1, wherein the processing solution is processed in a range of pH 6.3 to 8.0.

* * * * *